US005582320A

United States Patent [19]

Lin

[11] Patent Number: 5,582,320

[45] Date of Patent: Dec. 10, 1996

[54] BEVERAGE CONTAINER WITH EXTENDABLE DRINKING STRAW

[75] Inventor: Bang H. Lin, Taipei, Taiwan

[73] Assignee: Shing Hong Industrial Co., Ltd., Taipei, Taiwan

[21] Appl. No.: 391,688

[22] Filed: Feb. 21, 1995

[51] Int. Cl.[6] ..... A47G 19/22

[52] U.S. Cl. ..... 220/708; 220/709; 215/229

[58] Field of Search ..... 220/707, 708, 220/709; 215/229, 388, 389

[56] References Cited

U.S. PATENT DOCUMENTS

| | | | |
|---|---|---|---|
| 4,852,762 | 8/1989 | Chou-Sheng . | |
| 5,085,335 | 2/1992 | Carbaugh . | |
| 5,150,815 | 9/1992 | Saklad . | |
| 5,265,757 | 11/1993 | Wu . | |
| 5,273,172 | 12/1993 | Rossbach et al. . | |
| 5,337,918 | 8/1994 | Wang | 220/708 |
| 5,339,982 | 8/1994 | Tardie . | |
| 5,346,081 | 9/1994 | Lin | 215/229 |
| 5,361,934 | 11/1994 | Spence, Jr. | 220/707 |

*Primary Examiner*—Stephen K. Cronin
*Attorney, Agent, or Firm*—Beveridge, DeGrandi, Weilacher & Young, LLP

[57] ABSTRACT

A beverage container includes a rotatable cover and an automatically extendable drinking straw. The container includes an open ended body closed by a removable cap. A cover is fit onto the cap and is rotatable to a drinking position where a first straw section extends in an inclined manner upwardly through a yoke on the cap and a slot on the cover. The cover also may be rotated to a non-drinking position where the first straw section is moved within the cover and is pinched off to prevent leakage. The slot on the cover is closed by a curved member projecting from the top surface of the cap. A second straw section extends downwardly from the cap into the beverage container body.

15 Claims, 6 Drawing Sheets

BEVERAGE CONTAINER WITH EXTENDABLE DRINKING STRAW

BACKGROUND OF THE INVENTION

1. Field of the Invention

The present invention relates to a beverage container with a rotatable cover and an automatically extendable drinking straw, and more particularly, to such a container having a straw-bending member and a slot-closing member on a cap.

2. Description of the Prior Art

A beverage container with a rotatable cover and an automatically extendable straw as shown in FIGS. 1 and 2 was well known. This beverage container comprises a body 11, a cap 12, upper and lower straws 13 and 10 and a cover 14. The body 11 is a hollow cylindrical member for containing a beverage such as juice, water, etc.

The cap 12 is screwed onto an outer thread of the open end of the body 11. Upper and lower disk members 121, 122 of different diameters are formed with an annular groove 123 and two symmetric cuts 124. The cap 12 is formed with a through hole 126 to receive the straws 13, 10 through which a user can suck the beverage from the body 11. A member 125 with a flat top surface is also attached on the cap 12.

The cover 14 is disposed above the cap 12 and has an open end. Two symmetrically disposed projections 141 are formed on the inner edge of its open end corresponding to the cuts 124 in the cap 12. An upper wall of the cover 14 is formed with a slot 142 therein to receive the-upper straw 13 which extends therethrough. A stopper 143 is formed on the bottom surface of the upper wall in the vicinity of the slot 142.

When the projections 541 on the cover 14 are aligned with the cuts 124 on the cap 12, the cover 14 fits on the cap 12. The cover 14 can be rotated counterclockwise to move the slot 142 to a position above the upper straw 13 which then extends outwardly through the slot 142 by means of its own resilience to enable a user to suck the beverage from the body 11. Conversely, when the cover 14 is rotated clockwise, the upper straw 13 is acted on by the upper wall of the cover 14 and it is hereby withdrawn back into the cover. The rotation of the cover 14 is stopped when the stopper 143 on the cover 14 abuts against the member 125 which is then just below the slot 142 to block the slot 142 in order to prevent foreign objects from entering into the cover 14.

One drawback of such known container is that the member 125 having a flat top surface fails to effectively shield the slot 142 formed on the slightly arcuate upper wall of the cover member 14. Consequently, dust or other contaminants may pass through the clearance between the slot 142 and the member 125 to contaminate the upper straw 13 and the cap 12.

In the known container, only the cover 14 acts to bend the upper straw 13 causing it to be temporarily pinched off and thus preventing leakage when not in use. It is found, however, that the cover 14 fails to completely clamp off the upper straw 13 to prevent leakage because the bent upper straw 13 will incline upwardly within the cover 14 (FIG. 2).

Furthermore, it is also difficult for a user to recognize whether the cover 14 has been rotated to a position allowing the upper straw 13 to extend outwardly through the slot 142.

SUMMARY OF THE INVENTION

It is a primary object of the present invention to provide an improved beverage container with an automatically extendable straw of a novel structure such that when the straw is in its folded condition when not in use, leakage is effectively prevented while the slot on the cover is effectively blocked. Moreover, a user can easily recognize when the cover is rotated to either a position closing the slot or a position extending the straw outwardly.

According to the invention, there is thus provided a beverage container comprising an open ended body closed by a removable cap, straw means extending through the cap, a cover member rotatably fitted on the cap for rotational movement relative to the cap between a first position allowing the straw to extend outwardly through a slot of the cover member and a second position folding the straw, means for auxiliarily bending the straw, means for closing the slot to prevent contaminants from passing therethrough when the cover is rotated to the second position, and means for positioning the cover in either the first or second position.

BRIEF DESCRIPTION OF THE DRAWINGS

A preferred embodiment of the invention will now be described, by way of example only, with reference to the accompanying drawings, wherein.

DESCRIPTION OF THE PREFERRED EMBODIMENT

Figure 1:
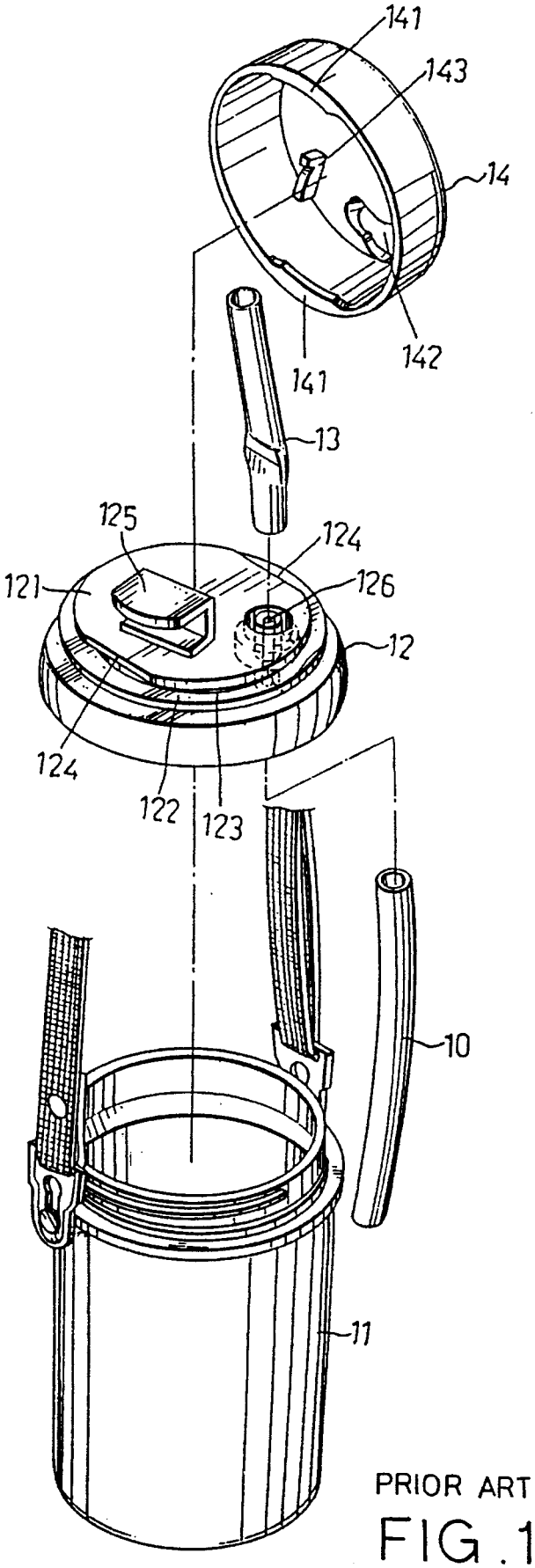
PRIOR ART FIG. 1
FIG. 1 is a perspective exploded view of a prior art container.
Figure 2:
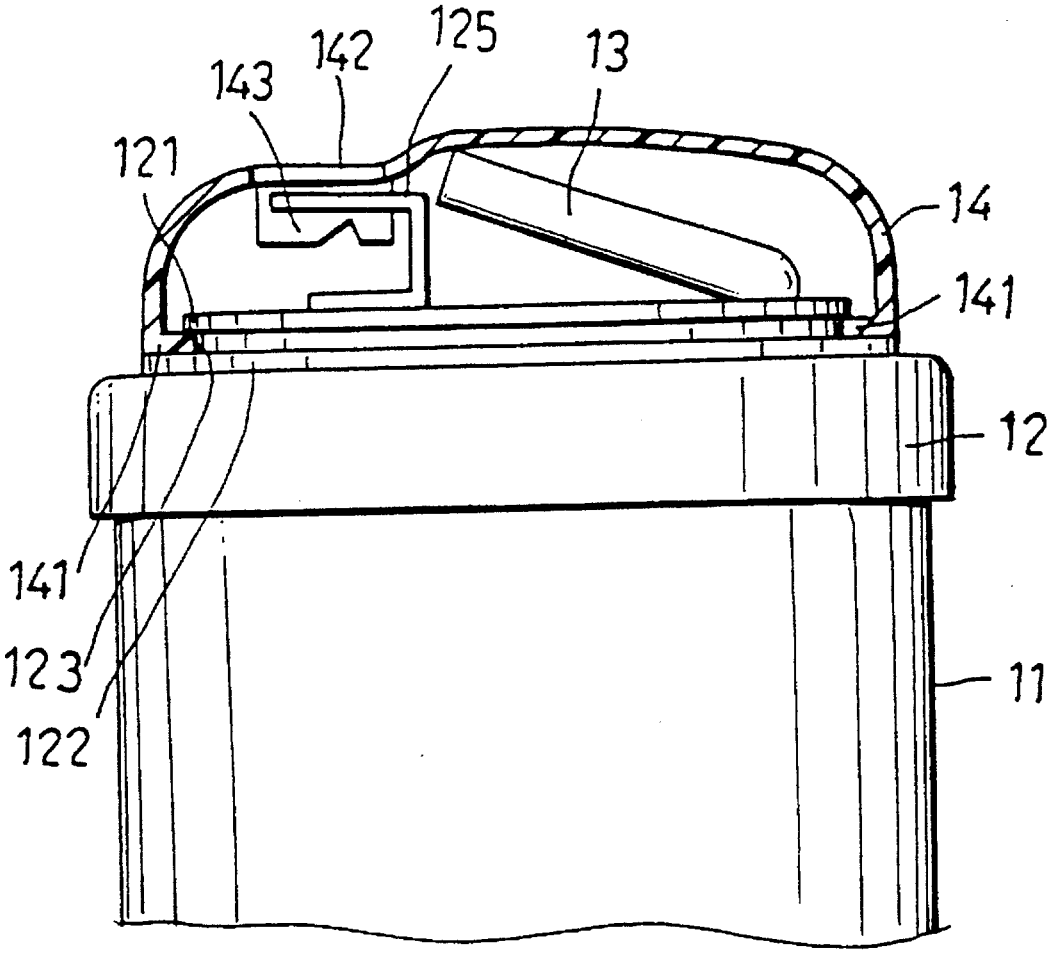
PRIOR ART FIG. 2
FIG. 2 is a perspective assembled view of the container shown in FIG. 1.
Figure 3:
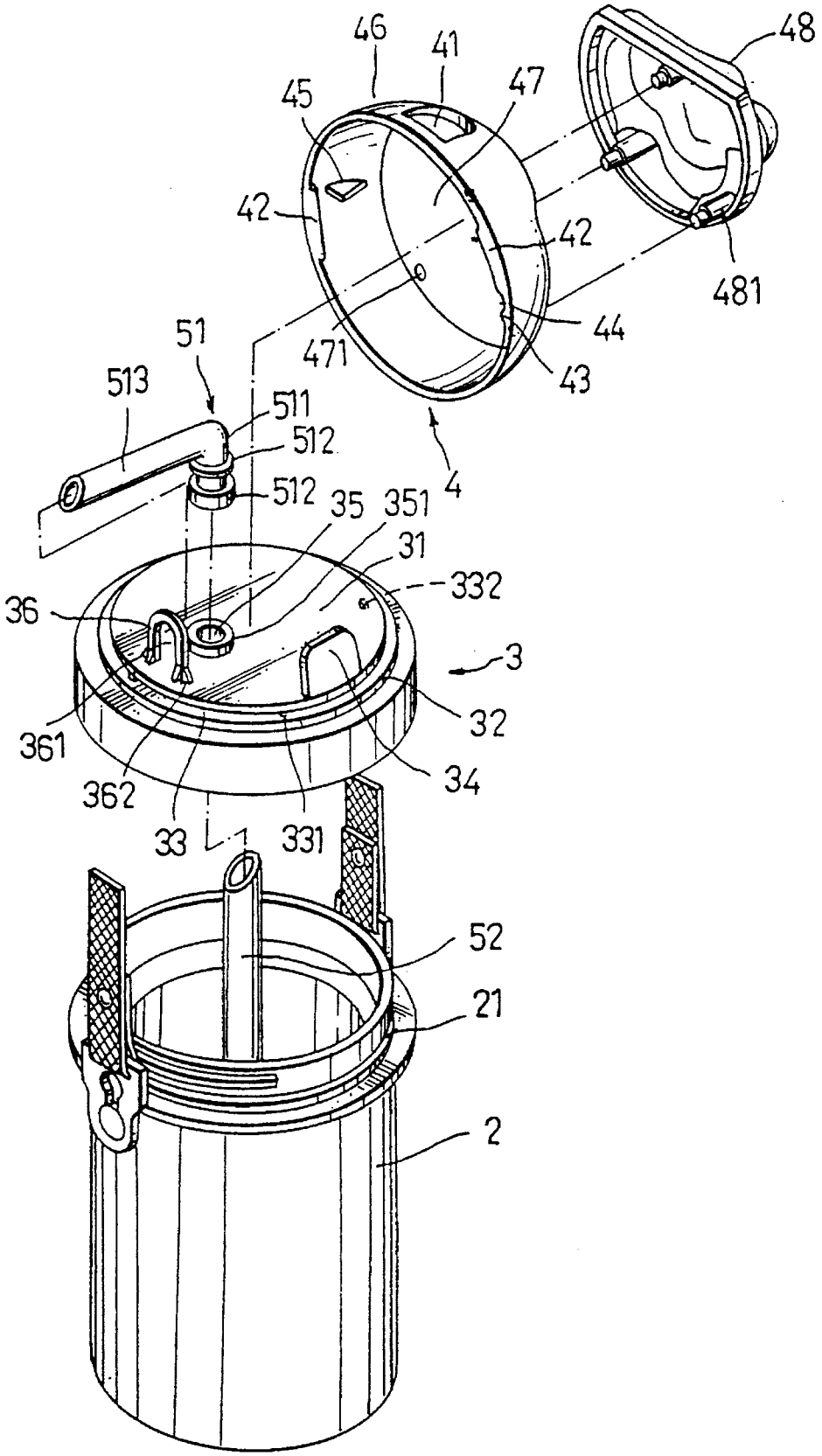
FIG. 3 is a perspective exploded view of a preferred embodiment of a container of the present invention.
Figure 4:
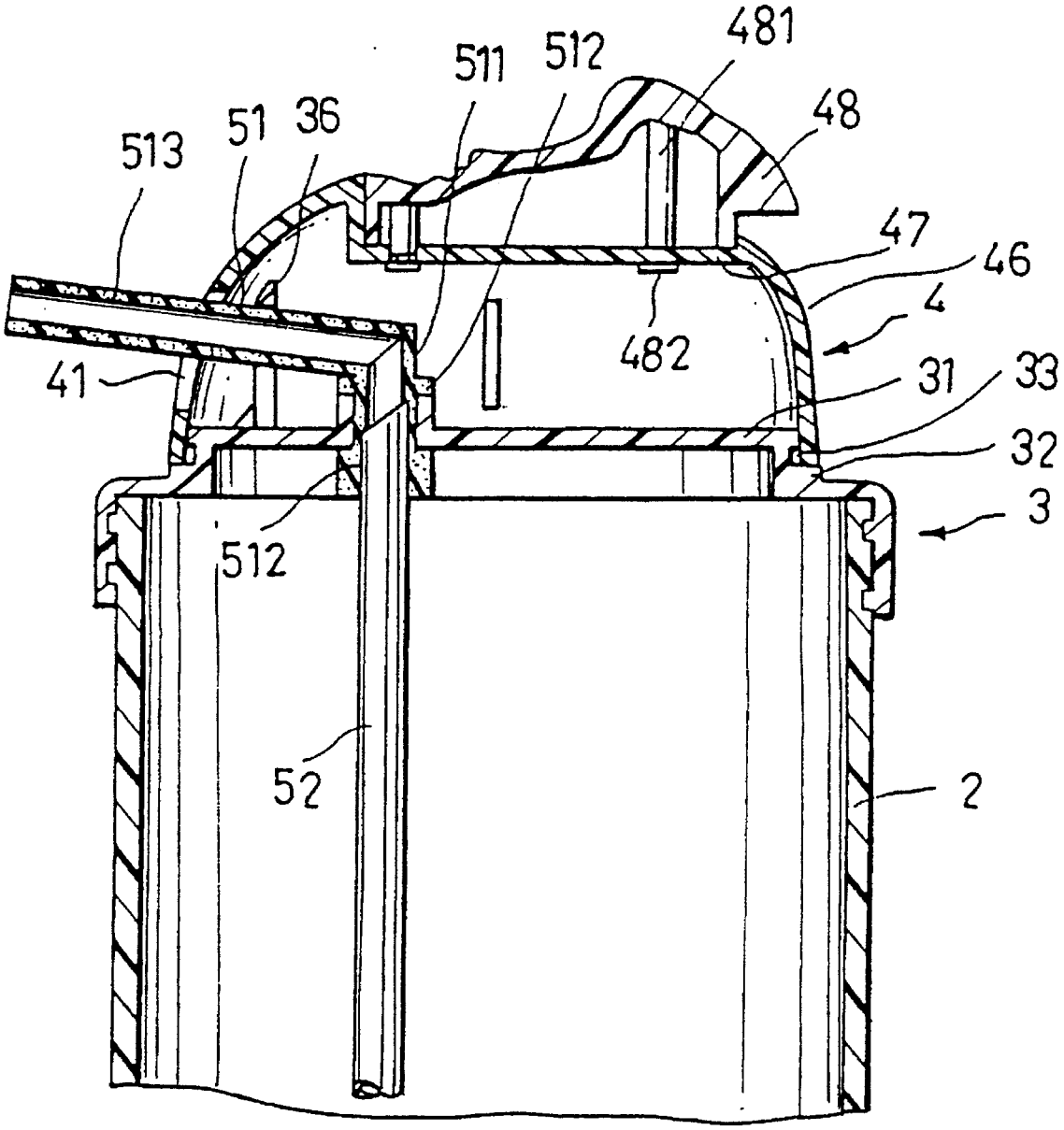
FIG. 4 is a side elevational, partially sectional view of the container of FIG. 3, with the straw extending outwardly for use.

Referring to FIGS. 3 and 4, the container of the present invention comprises a body 2, a cap 3, first and second straws or tubes 51,52, a cover 4, and a decorative member 48.

The container body 2 is a hollow cylindrical member for holding a beverage such as water, juice, etc. The upper end of the body 2 is formed with outer thread 21.

The cap 3 is screwed on the outer thread 21 of the body 2 to seal the body 2. The cap 3 is formed with a through hole 35 and a fixing seat 351 which projects from the upper side of the hole 35. Upper and lower disk members 31, 32 of different diameters are formed with an annular groove 33. First and second beads 331,332 project radially from the bottom of the groove 33. A shielding member 34 is fixedly mounted on the cap 3 on the edge of its top surface between the first and second beads 331,332. The shielding member 34 has curvature for a purpose to be described. An inverted U-shaped yoke 36 is fixedly mounted on the cap 3 near the edge of its top surface, the ends of the legs of the yoke 36 being provided with enhancing ribs 361,362, respectively.

The first tube or straw 51 is made of relatively soft, resilient material such as silicone and comprises a bent section 513 and a vertical section 511 having two integrally formed separated flanges 512. The first straw 51 is fitted on the through hole 35 in a manner that the fixing seat 351 is sandwiched between the two flanges 512 and that the bent section 513 extends inclinedly through the yoke 36. The second tube or straw 52 is made of rigid material such as polyester and extends downwardly into the interior of the body 2 and contacts the beverage contained therein. More particularly, the second straw 52 has an outer diameter slightly greater than the inner diameter of the first straw 51 such that when the second straw 52 is inserted into the first straw 51 already fitted on the hole 35, the second straw 52 is connected with the first straw 51 and held in position in a coaxial relation due to frictional force.

The straws 51, 52 thus mounted and connected allow a beverage contained in the body 2 to be removed therefrom under a sucking action. The bent section 513 of the first straw 51 is preferably inclined upwardly at 10 degrees with respect to a horizontal plane to facilitate the sucking process and to allow the beverage in the bent section 513 of the first straw 51 to flow back into the body 2 when the sucking process stops.

The cover 4 is disposed above the cap 3 and has a curved side wall 46 and top surface 47. Two symmetrically disposed projections 42 are formed on the inner edge of the open end of the cover 4 for slidably engaging the groove 33 on the cap 3, allowing the cover 4 to be rotated relative to the cap 3 as is known in the art. The cover 4 is preferably made of a rigid yet somewhat flexible material and is of such dimensions as to enable the snapping receipt of the projections 42 onto the groove 33. The side wall 46 of the cover 4 is formed with a slot 41 which can be aligned with the bent section 513 of the first straw 51 and the yoke 36 allowing the first straw 51 to extend outwardly therethrough for a user to use.

Figure 6:
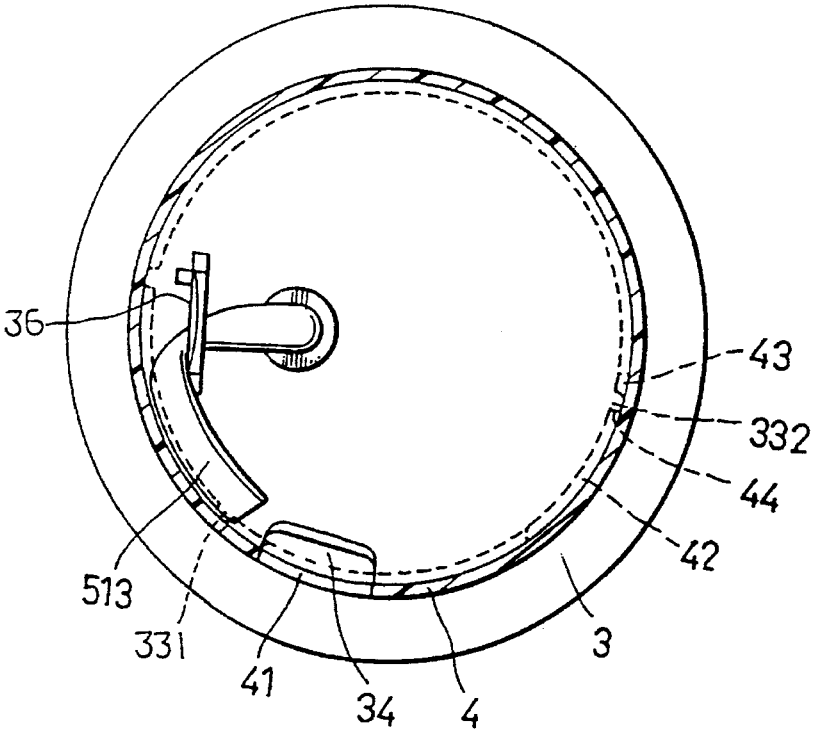
FIG. 6 is a top plan view of the container of FIG. 4, showing the straw in its closed or non-drinking mode.

The side wall 46 is designed to have an inner surface conforming to the outward surface of the curved shielding member 34 on the cap 3 such that the slot 41 formed on the side wall 46 of the cover 4 can be tightly closed by the curved shielding member 34 on the cap 3 when the container is in its non-drinking mode (see FIG. 6).

A plate 45 projects from the inner surface of the curved side wall 46 of the cover 4 above one of the projections 42. Adjacent another projection 42, a spot 43 is raised on the inner surface of the side wall 46 opposite to the plate 45. A recess 44 is formed on the side wall 46 between the spot 43 and the another projection 42. For achieving a varying and attractive effect, a decorative member 48 can be attached onto the top surface 47 of the cover 4. This may be made, for example, by having legs 481 of the decorative member 48 inserted through holes 471 formed on the top surface 47 and then expanding the end 482 of the legs 481 to mount the decorative member 48 thereon see FIG. 4.

Figure 7:
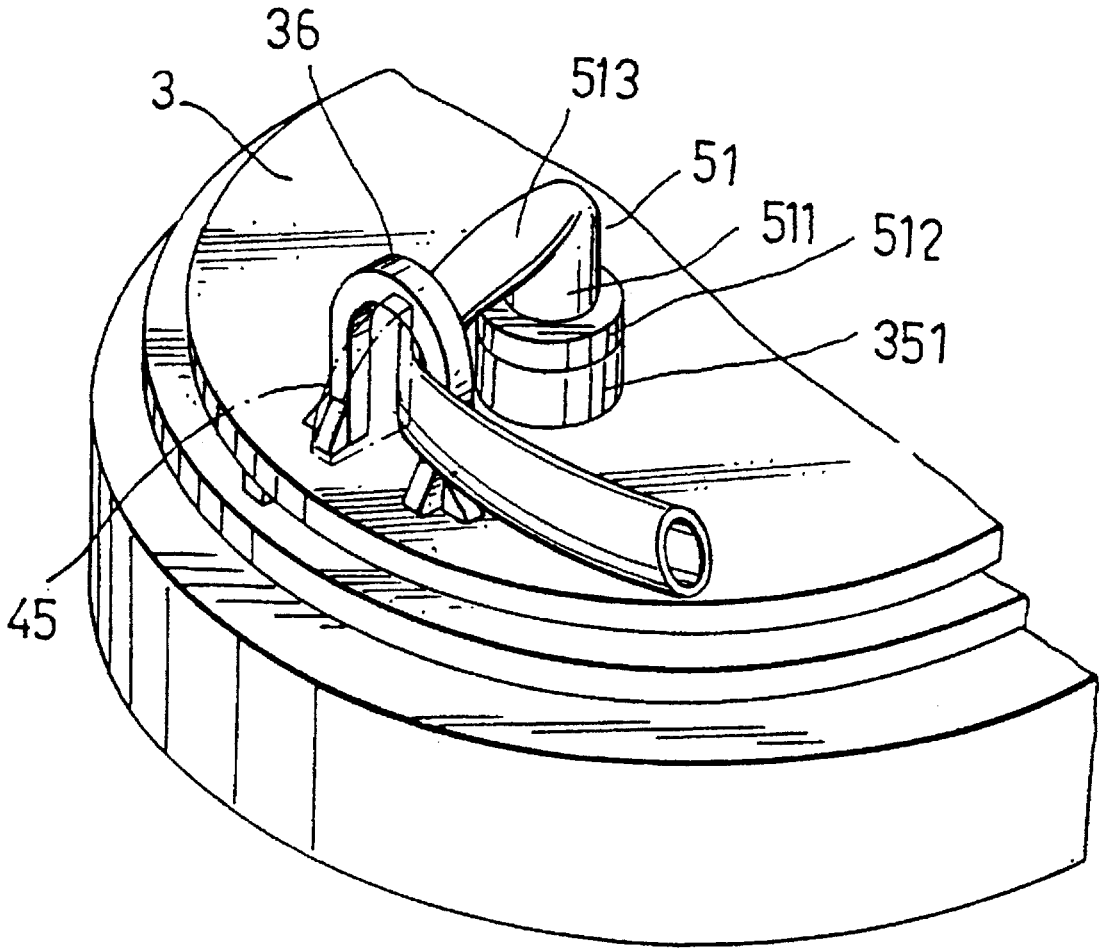
FIG. 7 is an enlarged, partially perspective view of the container of the invention, showing a straw in its closed position, with the cover removed for clearer illustration.

Referring now to FIGS. 4–7, the operation of the container of the invention will now be described. As shown in FIGS. 6 and 7, the first straw 51 is guided a folded through the association of the side wall 46 of the cover 4 with the yoke 36 on the cap 3 and received inside the cover 4, while the slot 41 formed on the side wall 46 of the cover 4 is tightly closed by the curved shielding member 34 on the cap 3.

Figure 5:
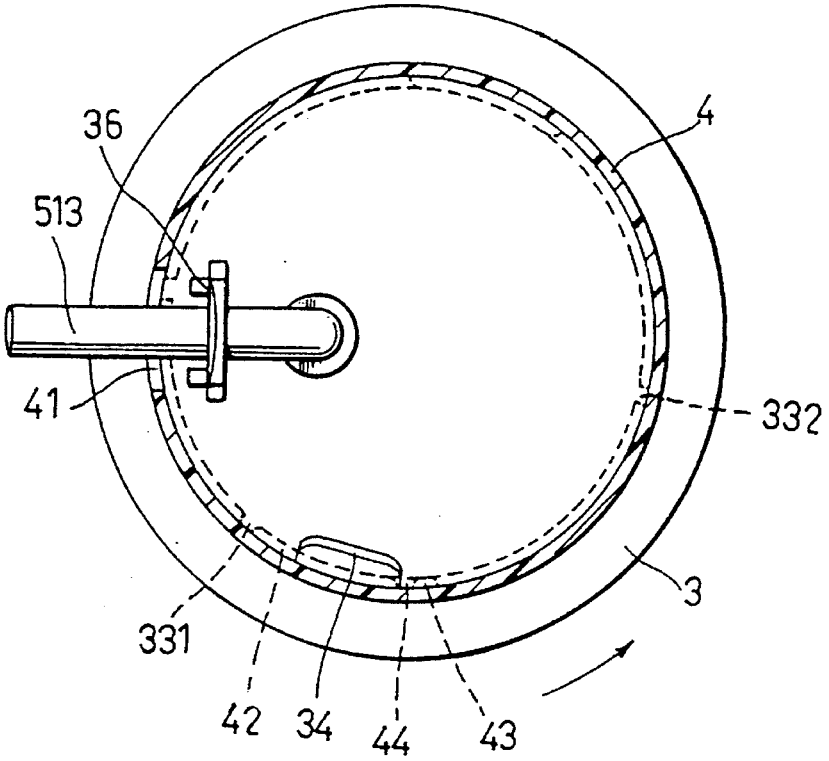
FIG. 5 is a top plan view of the container of FIG. 4, showing the straw extending outwardly for use.

When a user wishes to drink the beverage contained in the body 2, he or she only needs to rotate the cover 4 clockwise from the position shown in FIG. 6 to a position shown in FIG. 5 where the projection 42 on the cover 4 abuts against the bead 331 on the groove 33 to stop the rotational movement of the cover 4, and the slot 41 faces the yoke 36. Simultaneously, the bent section 513 of the first straw 51 is released and is restored to its extended drinking position by means of its own resilience, extending outwardly through the slot 41.

Conversely, when the first straw 51 needs to be retracted into the cover 4 of the container, the cover 4 is rotated counterclockwise to a position shown in FIGS. 6 and 7, where the projecting bead 332 formed on the groove 33 is positioned in the recess 44 formed on the cover 4, and the projecting plate 45 on the cover 4 presses the bent section 513 against the yoke 36 (FIG. 7). The cover 4 is then well located in a position where the bent section 513 is bent through the association of the yoke 36 and side wall 46 of the cover 4, and the shielding member 34 faces and tightly closes the slot 41.

The results and advantages of the above container constructed according to the present invention become clear when compared to the prior art container. Firstly, the container according to the invention can provide better leakage-proof for the first straw 51, because, besides the cover 4, the yoke 36 on the cap 3 and the plate 45 of the cover 4 also help to close the flow passage in the bent section 513 of the first straw 51. It is insured that there is no beverage remaining in the bent section 513 of the first straw 51 when there is no sucking action due to its upwardly inclined arrangement.

Secondly, since the shielding member 34 on the cap 3 is in a form conformable to the inner surface of the side wall 46, the cover 4 having its slot 41 tightly closed by the shielding member 34 completely isolates the cap 3 and the first straw 51 from the external environment and achieves hygienic purposes. Thirdly, the provision of beads 331,332 on the groove 33 of the cap 3 in association of the projections 42,42 and recess 44 on the cover 4 helps the user to recognize the proper rotational positioning of the cover 4 when he or she wants to either extends the first straw 51 outwardly through the slot 41 or withdraw the first straw 51 back into the cover 4.

It should be noted that the above embodiment is only an example of the present invention and any modification or derivation thereof should fall within the scope of the present invention.

What is claimed is:

1. A beverage container comprising:

a body;

a cap removably secured to an upper open end of said body, a curve member projecting from an edge of a top surface of said cap, and a yoke mounted on said cap near the edge of the top surface of said cap;

a straw extending above and below an opening defined in said cap, said straw having a first section extending in an inclined manner through said yoke and outside of said body, and a second section extending into said body;

a cover rotatably secured over said cap, said cover having a laterally facing slot therein which can be aligned with the first section of said straw, wherein said yoke allows said first section to extend outwardly through the slot upon rotational movement of said cover to a first angular position, and upon rotation movement of said cover to a second angular position, said cover bends said first section against said yoke to a condition where beverage cannot leak out and said first section of said straw is made of resilient material, said first section having two integrally formed separated flanges formed proximate a first end of the first section for fitting the first section of said straw on said opening of said cap, and wherein said second section of said straw is made of a rigid material, wherein a first end of said second section of said straw is inserted into said first end of said first section of said straw and is held in said first section and wherein said cap is provided with an upper disk member and a lower disk member, wherein the upper disk member and the lower disk member have different diameters, wherein an annular groove is defined between said upper disk member and said lower disk member, and wherein a first bead and a second bead project from bottom of said annular groove for engaging with said cover.

2. A container as claimed in claim 1 wherein the first bead abuts against a projection in the cover when the cover is in the first angular position.

3. A container as claimed in claim 2, wherein the second bead is received in a recess defined in an inner surface of the cover when the cover is in the second angular position.

4. A beverage container comprising:

a body;

a cap removably secured to an upper open end of said body, a curved member projecting from an edge of a top surface of said cap, and a yoke mounted on said cap near the edge of the top surface of said cap;

a straw extending above and below an opening defined in said cap, said straw having a first section extending in an inclined manner through said yoke and outside of said body, and a second section extending into said body;

a cover rotatably secured over said cap, said cover having a laterally facing slot therein which can be aligned with the first section of said straw, wherein said yoke allows said first section to extend outwardly through the slot upon rotational movement of said cover to a first angular position, and upon rotational movement of said cover to a second angular position, said cover bends said first section against said yoke to a condition where beverage cannot leak out and wherein the cap includes an annular groove defined therein, and wherein a first bead and a second bead project into the annular groove for engaging with the cover.

5. A container as claimed in claim 4, wherein the first bead abuts against a projection in the cover when the cover is in the first angular position.

6. A container as claimed in claim 5, wherein the second bead is received in a recess defined in an inner surface of the cover when the cover is in the second angular position.

7. A container as claimed in claim 4, wherein the second bead is received in a recess defined in an inner surface of the cover when the cover is in the second angular position.

8. A beverage container comprising:

a body;

a cap removably secured to an upper open end of said body, a curved member projecting from an edge of a top surface of said cap, and a yoke mounted on said cap near the edge of the top surface of said cap;

a straw extending above and below an opening defined in said cap, said straw having a first section extending in an inclined manner through said yoke and outside of said body, and a second section extending into said body;

a cover rotatably secured over said cap, said cover having a laterally facing slot therein which can be aligned with the first section of said straw, wherein said yoke allows said first section to extend outwardly through the slot upon rotational movement of said cover to a first angular position, and upon rotational movement of said cover to a second angular position, said cover bends said first section against said yoke to a condition where beverage cannot leak out and wherein the yoke is an inverted U-shaped member which extends from the top surface of the cap.

9. A container as claimed in claim 8, wherein ribs extend between each leg of the inverted U-shaped member and the top surface of the cap.

10. A beverage container comprising:

a body;

a cap removably secured to an open end of the body, a curved member projecting from an edge of a first surface of the cap, and a yoke mounted on the cap proximate the edge of the first surface of the cap, wherein an opening is defined in the first surface of the cap;

a straw extending above and below the opening in the cap, the straw having a first section extending through the yoke and outside of the body, such that the yoke holds the first section in an inclined manner, and a second section of the straw extends into the body;

a cover secured over the cap, the cover having a slot defined therein, wherein when the cover is located at a first position, the yoke allows the first section to extend through the slot, and when the cover is located at a second position, the cover bends the first section against the yoke to a condition where the first section is retracted into the cover, and wherein the cap includes an annular groove defined therein, and wherein a first bead and a second bead project into the annular groove for engaging with the cover.

11. A container as claimed in claim 10, wherein the first bead abuts against a projection in the cover when the cover is in the first position.

12. A container as claimed in claim 11, wherein the second bead is received in a recess defined in an inner surface of the cover when the cover is in the second position.

13. A container as claimed in claim 10, wherein the second bead is received in a recess defined in an inner surface of the cover when the cover is in the second position.

14. A beverage container comprising:

a body;

a cap removably secured to an open end of the body, a curved member projecting from an edge of a first surface of the cap, and a yoke mounted on the cap proximate the edge of the first surface of the cap, wherein an opening is defined in the first surface of the cap;

a straw extending above and below the opening in the cap, the straw having a first section extending through the yoke and outside of the body, such that the yoke holds the first section in an inclined manner, and a second section of the straw extends into the body;

a cover secured over the cap, the cover having a slot defined therein, wherein when the cover is located at a first position, the yoke allows the first section to extend through the slot, and when the cover is located at a second position, the cover bends the first section against the yoke to a condition where the first section is retracted into the cover, and wherein the yoke is an inverted U-shaped member which extends from the first surface of the cap.

15. A container as claimed in claim 14, wherein ribs extend between each leg of the inverted U-shaped member and the first surface of the cap.

* * * * *